US005730005A

United States Patent [19]

Chen

[11] Patent Number: 5,730,005

[45] Date of Patent: Mar. 24, 1998

[54] FABRIC ROLLING-UP DEVICE AND CONTROL CIRCUIT ASSEMBLY

[75] Inventor: Wan-Yih Chen, Taipei, Taiwan

[73] Assignee: Pai Lung Machinery Mill Co., Ltd., Taipei, Taiwan

[21] Appl. No.: 709,328

[22] Filed: Sep. 5, 1996

[51] Int. Cl.[6] ..... D04B 15/88

[52] U.S. Cl. ..... 66/151; 66/153

[58] Field of Search ..... 66/151, 153

[56] References Cited

U.S. PATENT DOCUMENTS

| | | | |
|---|---|---|---|
| 4,879,886 | 11/1989 | Okada et al. | 66/151 |
| 5,157,949 | 10/1992 | Sawazaki et al. | 66/151 |
| 5,224,362 | 7/1993 | Sawazaki et al. | 66/151 |
| 5,457,967 | 10/1995 | Scherzinger | 66/151 |
| 5,537,845 | 7/1996 | Lin | 66/151 |

*Primary Examiner*—John J. Calvert
*Attorney, Agent, or Firm*—Bacon & Thomas

[57] ABSTRACT

A fabric rolling-up device control circuit assembly connected to a knitting machine to control the operation of a fabric rolling-up device in rolling up fabric knitted by the knitting machine, including a power circuit, an analog signal processor, a power amplifier controlled by the analog signal processor to turn on the motors of the fabric-rolling up device in rolling up the fabric, a speed regulation circuit for regulating the revolving speed of the motors, a torsion regulation circuit controlled by a number of revolution detector and an auto torsion adding control circuit to increase the torsion force of the motors automatically, an external abnormal signal detector adapted for turning off the motor when the knitting machine is stopped, and an abnormal signal detector adapted for turning off the knitting machine when the motors are in an abnormal status.

8 Claims, 6 Drawing Sheets

FABRIC ROLLING-UP DEVICE AND CONTROL CIRCUIT ASSEMBLY

BACKGROUND OF THE INVENTION

The present invention relates to the fabric rolling-up device of a knitting machine, and relates more particularly to such a fabric rolling-up device and control circuit assembly which uses an auto-control circuit to automatically control a torque motor in regulating the torsion so that the fabric is smoothly and evenly rolled up.

When a fabric is knitted by a knitting machine, it is then rolled up by a fabric rolling-up device through a belt transmission mechanism. This structure of belt transmission mechanism, as shown in FIG. 1, is comprised of an upper belt wheel, a belt wheel on the right side, a belt wheel beneath, a torsion spring of the belt wheel on the right side, a central adjustment screw, and a belt circling around said three belt wheels. The tension of the belt is controlled by the torsion spring. The spring force of the torsion spring is adjusted through the adjustment screw. When the fabric is continuously rolled the diameter of the roll of fabric is gradually increased. When the diameter of the roll of fabric is gradually increased, the torsion force shall be relatively increased so that the fabric can be smoothly and evenly rolled up. Because the tension of the belt 136 is adjusted manually, it cannot be automatically adjusted subject to the change of the diameter of the roll of fabric being rolled up. Therefore, the two opposite ends of the finished roll of fabric cannot be maintained in a flush manner (see FIG. 2).

SUMMARY OF THE INVENTION

It is one object of the present invention to provide a fabric rolling-up device and control circuit assembly which uses an automatic control circuit to control the operation of two torque motors in turning the upper fabric roller and lower fabric rolling of the fabric rolling-up device in rolling up the fabric efficiently. It is another object of the present invention to provide a fabric rolling-up device and control circuit assembly which automatically regulates the torsion force of the torque motors in turning the upper fabric roller and lower fabric roller of the fabric rolling-up device to roll up the fabric smoothly, It is still another object of the present invention to provide a fabric rolling-up device and control circuit assembly which uses an external abnormal signal detector to detect the operation of the knitting machine so as to turn off the torque motors when the knitting machine is in an abnormal condition. It is still another object of the present invention to provide a fabric rolling-up device and control circuit assembly which uses an abnormal signal detector to detect the torque motors so as to provide a signal to the knitting machine, causing the knitting machine be turned off when the torque motors are in an to abnormal condition. It is still another object of the present invention to provide a fabric rolling-up device and control circuit assembly which uses a torsion regulation circuit to automatically regulate the torsion of the fabric totters of the fabric rolling-up device.

DETAILED DESCRIPTION OF THE PREFERRED EMBODIMENT

Figure 1:
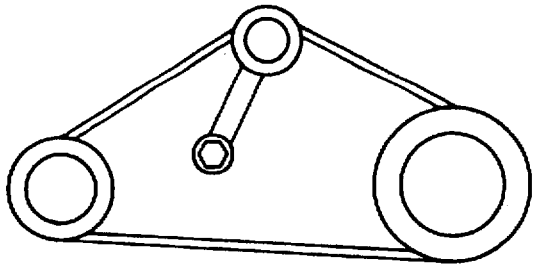
Fig. 1 PRIOR ART
FIG. 1 shows the structure of a fabric rolling-up device according to the prior art.
Figure 2:
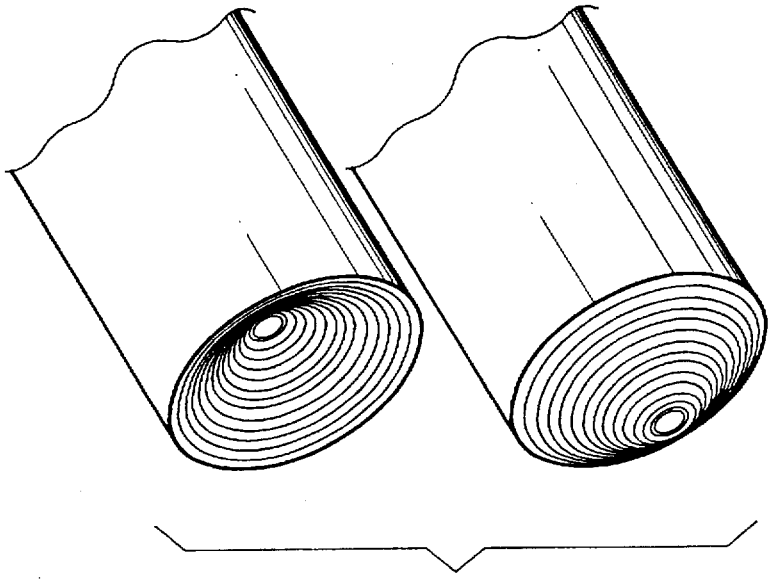
Fig. 2 PRIOR ART
FIG. 2 is a schematic drawing showing a fabric rolled up by the fabric rolling-up device shown in FIG. 1.
Figure 3:
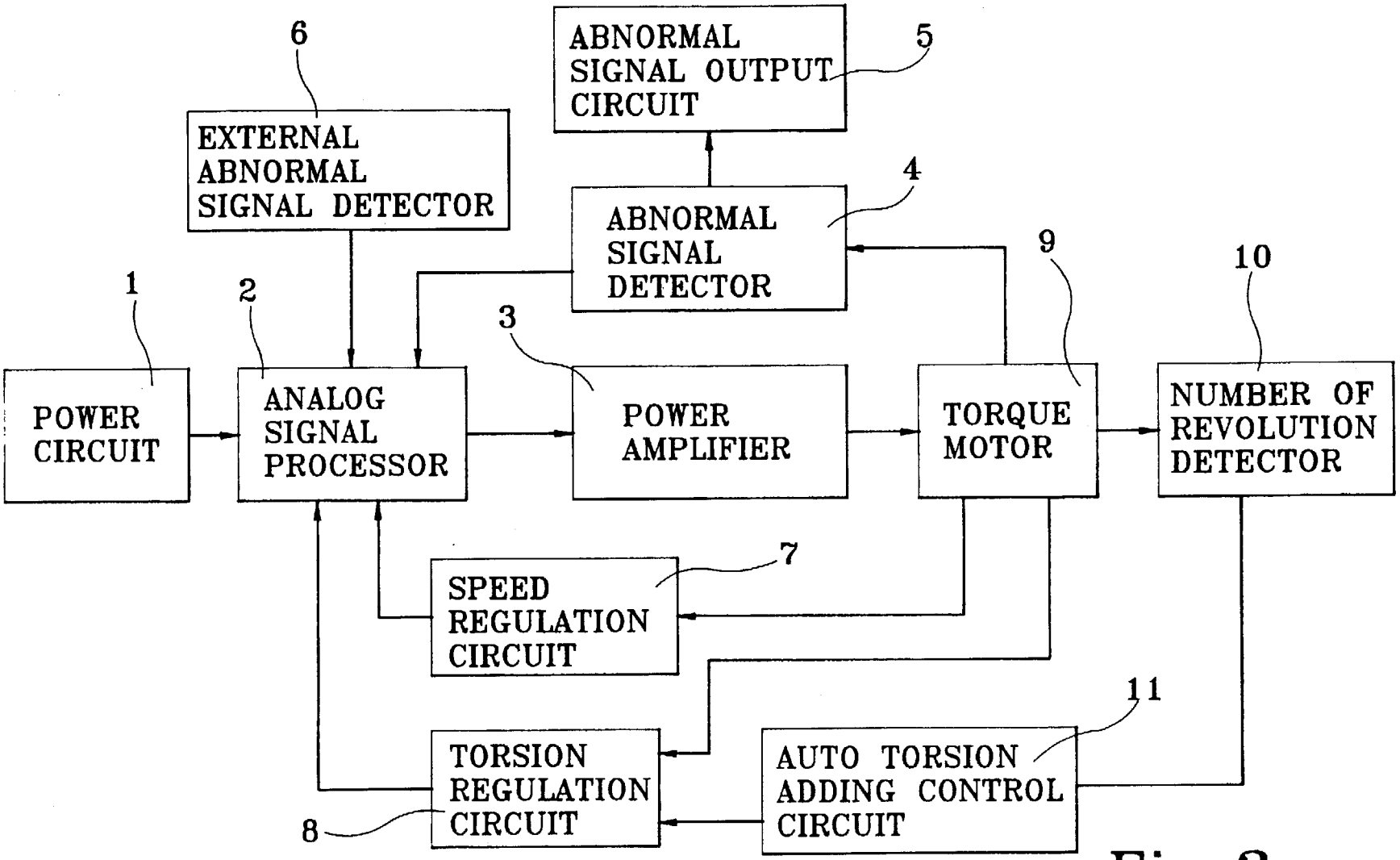
FIG. 3 is a block diagram of the control circuit of the fabric rolling-up device and control circuit assembly of the present invention.
Figure 4:
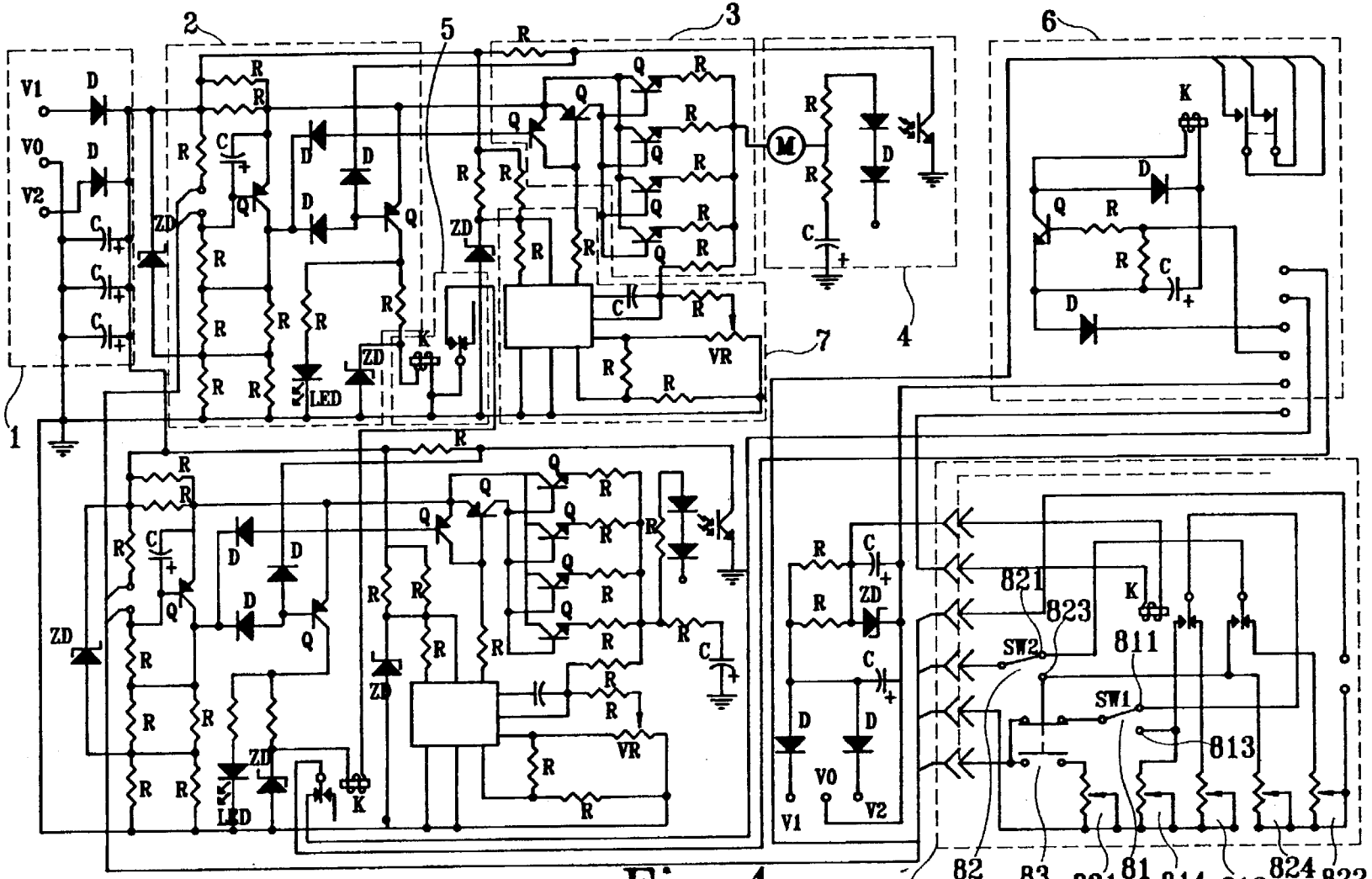
FIG. 4 is a circuit diagram of the control circuit of the fabric rolling-up device and control circuit assembly of the present invention.

Referring to FIGS. 3 and 4, a control circuit for controlling the operation of a fabric rolling-up device in accordance with the present invention, is general comprised of a power circuit 1, an analog signal processor 2, a power amplifier 3, an abnormal signal detector 4, an abnormal signal output circuit 5, an external abnormal signal detector 6, a speed regulation circuit 7, a torsion regulation circuit 8, two external torque motors 9, a number of revolution detector 10, and an auto torsion adding control circuit 11.

Figure 6:
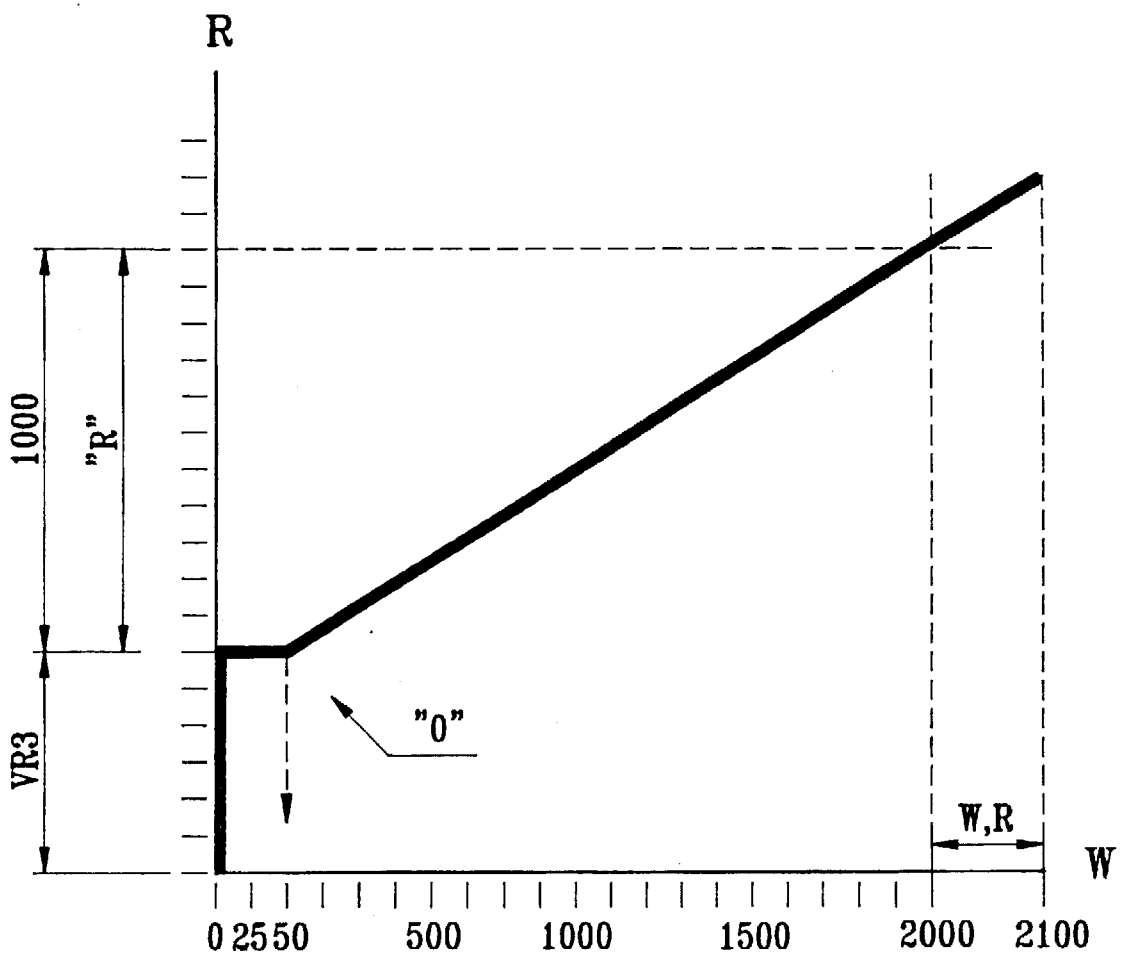
FIG. 6 is a control curve according to the present invention.

The power circuit 1 receives external power supply, and provides it to the analog signal processor 2, permitting it to be further amplified by the power amplifier 3 and then sent to the external torque motors 9, causing the external torque motors 9 to rotate. In order to prevent the fabric from being rolled up in an excessively tight or loose condition, the torsion of the lower fabric roller of the fabric rolling-up device, which is controlled to roll tip the fabric (not shown), can be adjusted through the torsion regulation circuit 8. The torsion regulation circuit 8 comprises a first switch 81, a second switch 82, and a third switch 83. When the second switch 82 of the torsion regulation circuit 8 is shifted to a first position 823, a corresponding variable resistor, namely, the third variable resistor 824, can then be adjusted from 0–50. The parameter for the curve from 0–50 as shown in FIG. 6 (in which W: weight counted on the number of revolution; 0: the starting point of tension; R: the amount of tension output; WR: number of revolution required for dust removal) is an initial setting. This initial setting is done subject to the operator's experience. When the second switch 82 is shifted to the first position 823, the tension force, either during the operation of the fabric rolling-up device or when the machine is stopped, is adjusted through the third variable resistor 824. If the second switch 82 is shifted to a second position 821, the tension force is adjusted through the third variable resistor 824 when the fabric rolling-up device is operated, or a fourth variable resistor 822 when the fabric rolling-up device is stopped.

The fabric which is to be rolled up by the lower fabric roller of the fabric rolling-up device is guided by an upper fabric roller of the fabric rolling-up device to the lower fabric roller. The tension force of the upper fabric roller of the fabric rolling-up device is also regulated through the torsion regulation circuit 8. When the first switch 81 of the torsion regulation circuit 8 is switched to a first position 813, a corresponding variable resistor, namely, the first variable resistor 814 can then be adjusted to regulate the tension force of the upper fabric roller of the fabric rolling-up device. When the first switch 81 is shifted to the first position 813, the tension force, either during the operation of the fabric rolling-up device or when the machine is stopped, is adjusted through the first variable resistor 814. If the first switch 81 is shifted to a second position 811, the tension force is adjusted through the first variable resistor 811 when the fabric rolling-up device is operated, or a second variable resistor 812 when the fabric rolling-up device is stopped.

Referring to FIG. 6 again, the setting for the curve at 50–2000 is done through the third variable resistor 824 of the torsion regulation circuit 8 to turn the external torque motor at 50–2000 r.p.m. When the corresponding external torque motor 9 turns the lower fabric roller at 50–2000 r.p.m., the auto torsion adding control is clone in such a manner that the number of revolution detector 10 detects the number of revolution of the corresponding external torque motor 9, and sends a signal to the auto torsion adding control circuit 11, causing it to regulate the torsion regulation circuit 8, and the signal of the regulated value is then sent from the torsion regulation circuit 8 through the analog signal processor 2 and the power amplifier 3 to the corresponding external torque motor 9, causing it to turn the lower fabric roller in rolling up the fabric. When the fabric rolled up by the lower fabric roller of the fabric rolling-up device (first machine shut-off), it enters the setting of the number of revolution for dust removal of WR in FIG. 6. The setting of WR value is done through a software in the analog signal processor 2 to control the revolution of the external torque motor 9. Within the setting of this WR value, the air gun is operated to remove dust from the fabric roll, causing a layer of cotton flocks to be gathered at the bottom for cutting (during the second machine shut-off). When a first piece goods is finished, the external counter (not shown is set again by the operator for counting the rolling of a nest piece goods.

When the external torque motors 9 are out of control or damaged, the abnormal signal detector 4 immediately provides a signal to the analog signal processor 2, permitting the signal to be further amplified by the power amplifier 3 and then sent to the external torque motors 9 to stop the external torque motors 9 from operation. At the same time, the abnormal signal detector 4 sends the signal to he abnormal signal output circuit 5, causing it to shut off the knitting machine. If the knitting machine is stopped because of an abnormal condition, the abnormal status signal is received by the external abnormal signal detector 6 and then sent by it to the external torque motors 9 through the analog signal processor 9 and the power amplifier, causing he external torque motors 9 to be turned off. If the revolving speed of each external torque motor 9 is too fast or too can be corrected through the speed regulation circuit 7 The setting of the revolving speed of each external torque motor 9 is made at factory through the speed regulation circuit 7 if the tension force of the upper fabric roller is below the predetermined value, the third switch 83 is switched on, permitting a corresponding variable resistor, namely, the fifth variable resistor 831 to be regulated to provide a pulling force to pull up the upper fabric roller instantly, so that the tension force of the upper fabric roller can be further adjusted through the third variable resistor 824.

Figure 5:
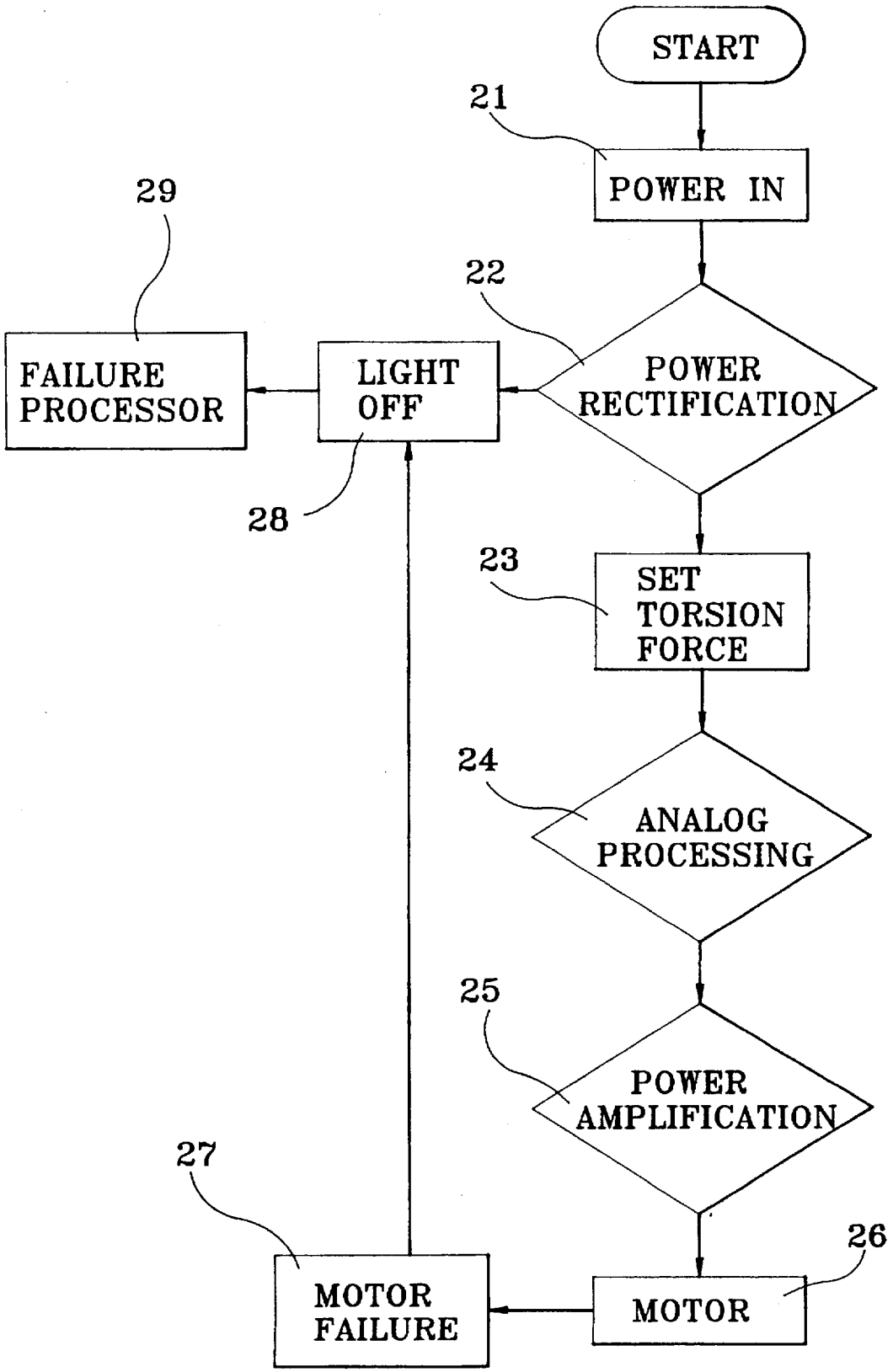
FIG. 5 is a control flow chart showing the operation of the present invention.

FIG. 5 shows the control flow chart of the present invention. As illustrated, when the fabric rolling-up device and control circuit assembly is started, it enters step 21 to input power supply, then enters step 22 to judge if it is to rectify power supply. If the judgment is negative, it enters step 28 in which the indicator light is off, and the enters step 29 to the failure processor. On the contrary, if the judgment is positive, it enters step 23 to regulate the variable resistor so as to set the tension force, then enters step 24 to make an analog procession, and then enters step 25 to amplify he signal, and then enters step 26 to control the motor, and then enters step 27 ff the motor is out of speed or fails to work properly, and then enters step 28 in which the indicator light is off, and then enters step 29 to the failure processor.

Figure 7:
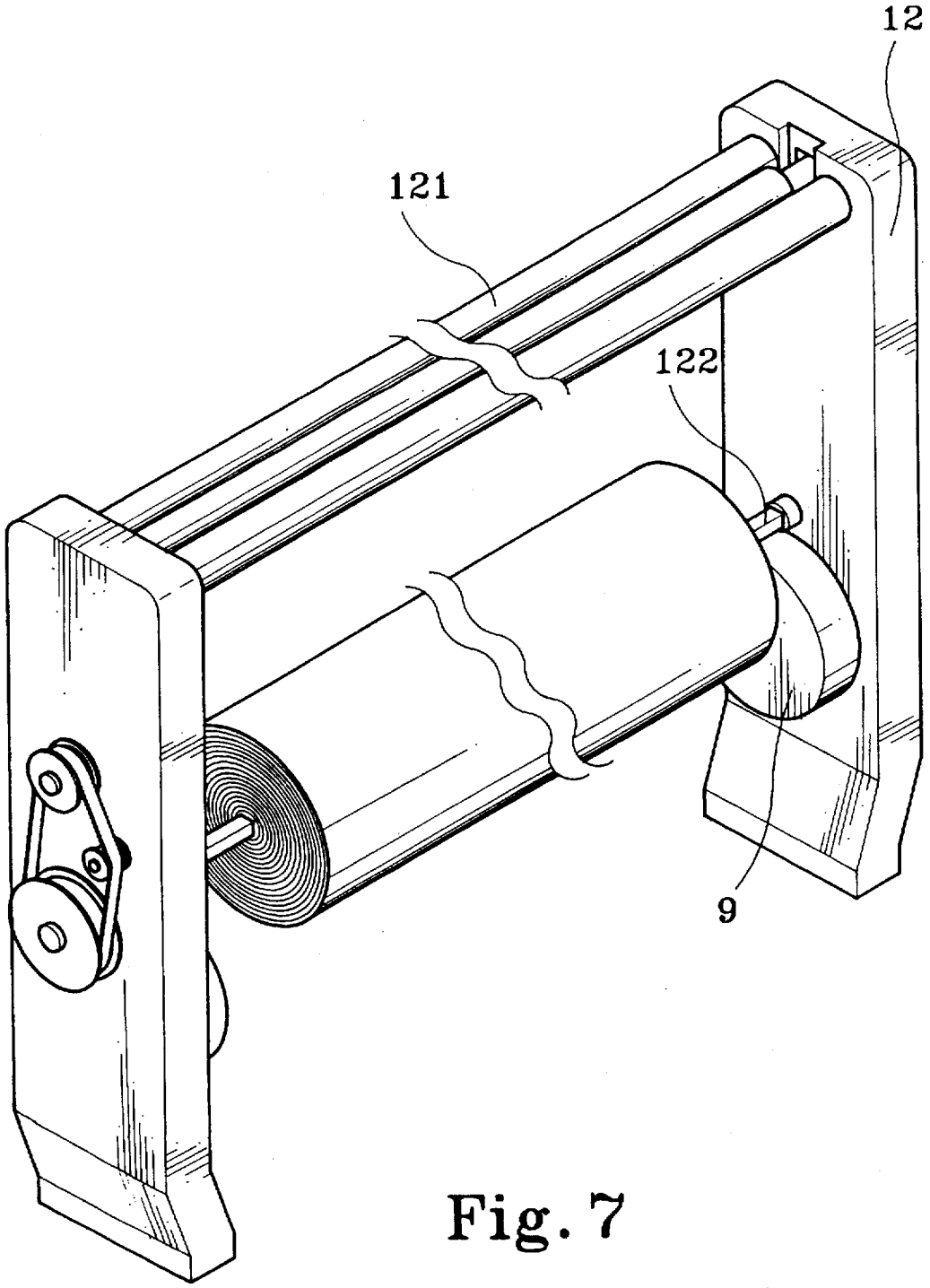
FIG. 7 shows the structure of the fabric rolling-up device according to the preset invention.

Referring to FIG. 7, the fabric rolling-up device 12 comprises an upper fabric roller 121 adapted for guiding the fabric forwards, a lower fabric roller 122 turned to roll up the fabric being guided from the upper fabric roller 121, and to external torque motors 9 disposed at two opposite sides and controlled to turn the tipper fabric roller 21 and the lower fabric roller 122 respectively.

I claim:

1. A fabric rolling-up device control circuit assembly connected to a knitting machine to control the operation of a fabric rolling-up device in rolling up fabric knitted by said knitting machine, comprising:

a power circuit for rectifying external power supply so as to provide the assembly with necessary working power supply;

an external abnormal signal detector for detecting the operation of said knitting machine, said external abnormal signal detector providing an abnormal signal when said knitting machine is abnormal;

two external torque motors controlled to turn an upper fabric roller and a lower fabric roller of said fabric rolling-up device in rolling up the fabric;

an abnormal signal detector for detecting the operation of said external torque motors, said abnormal signal detector providing an abnormal signal to turn off said knitting machine when said external torque motor is abnormal;

an abnormal signal output circuit connected to said knitting machine for receiving the abnormal signal of said abnormal signal detector for turning off said knitting machine;

an analog signal processor for receiving the working power supply from said power circuit to turn on said external torque motors, and for receiving the abnormal signal from said external abnormal signal detector and the abnormal signal from said abnormal signal detector to turn off said external torque motors;

a power amplifier connected between said analog signal processor and said external torque motors, and controlled by said analog signal to control the operation of said external torque motors;

a number of revolution detector for detecting the number of revolution of said external torque motors;

a speed regulation circuit for setting the revolving speed of said external torque motors, permitting the set value to be processed through said analog signal processor and then sent through said power amplifier to control the revolving speed of said external torque motors;

an auto torsion adding control circuit for receiving a signal of the number of revolutions of said external torque motor detected by said number of revolution detector, so as to control said torsion regulation circuit in regulating the torsion of said external torque motors subject to a value of the signal received; and a torsion regulation circuit for receiving the output torsion force regulation signal from said auto torsion adding control circuit to increase the torsion of said external torque motors.

2. The fabric rolling-up device control circuit assembly of claim 1 wherein said torsion regulation circuit comprises a first switch shifted between a first position and a second position, and a first variable resistor for controlling the torsion of said upper fabric roller when said fabric rolling-up device is operated and when said first switch is shifted to the first position.

3. The fabric rolling-up device control circuit of claim 2 wherein said torsion regulation circuit further comprises a second variable resistor for controlling the torsion of said upper fabric roller when said fabric rolling-up device is stopped and said first switch is shifted to the second position.

4. The fabric rolling-up device control circuit of claim 2 wherein said torsion regulation circuit further comprises a second switch shifted between a first position and a second position, and a third variable resistor for regulating the torsion of the lower fabric roller of said fabric rolling-up device when said second switch is switched to the second position.

5. The fabric rolling-up device of claim 4 wherein said third variable resistor is controlled to regulate the torsion of the lower fabric roller of said fabric rolling-up device when said second switch is switched to the second position during the operation of said fabric-rolling.

6. The fabric rolling-up device of claim 4 wherein said torsion regulation circuit further comprises a fourth variable resistor for regulating the torsion of the lower fabric roller of said fabric rolling-up device when said second switch is shifted to the second position and when said fabric rolling-up device is stopped.

7. The fabric rolling-up device of claim 1 wherein said analog signal processor is programmed with software for controlling the revolving speed of said external torque motor during a dust removal procedure in removing cotton flocks from the fabric being rolled up.

8. The fabric rolling-up device of claim 6 wherein said torsion regulation circuit further comprises a third switch and a fifth variable resistor, said fifth variable resistor being controlled to provide a pulling force to pull up the upper fabric roller of said fabric rolling-up device when the tension force of the upper fabric roller drops below a predetermined value and said third switch is switched on, so that the tension force of the upper fabric roller of said fabric rolling-up device can be further adjusted through said third variable resistor.

* * * * *